United States Patent [19]

Graiff

[11] 4,357,148

[45] Nov. 2, 1982

[54] METHOD AND FUEL COMPOSITION FOR CONTROL OR REVERSAL OF OCTANE REQUIREMENT INCREASE AND FOR IMPROVED FUEL ECONOMY

[75] Inventor: Leonard B. Graiff, Houston, Tex.

[73] Assignee: Shell Oil Company, Houston, Tex.

[21] Appl. No.: 253,344

[22] Filed: Apr. 13, 1981

[51] Int. Cl.[3] ..... C10L 1/22

[52] U.S. Cl. ..... 44/62; 44/72; 44/55; 44/77; 44/71

[58] Field of Search ..... 44/62, 72, 77, 55, 71

[56] References Cited

U.S. PATENT DOCUMENTS 3,931,024 1/1976 Hu ..... 44/71

4,022,589 5/1977 Alquest et al. ..... 44/71

*Primary Examiner*—Jacqueline V. Howard

*Attorney, Agent, or Firm*—John M. Duncan

[57] ABSTRACT

The control or reversal of octane requirement increase phenomenon together with improved fuel economy in a spark ignition internal combustion engine is achieved by introducing with the combustion charge a fuel composition containing an octane requirement increase-inhibiting amount of (a) certain oil soluble aliphatic polyamines and (b) certain low molecular weight polymers and/or copolymers of monoolefins having up to 6 carbon atoms, in certain ratio.

11 Claims, 4 Drawing Figures

FIG.1 OCTANE REQUIREMENT INCREASE CONTROL ACTIVITY OF THE ADDTIVE PACKAGE OF THE INVENTION
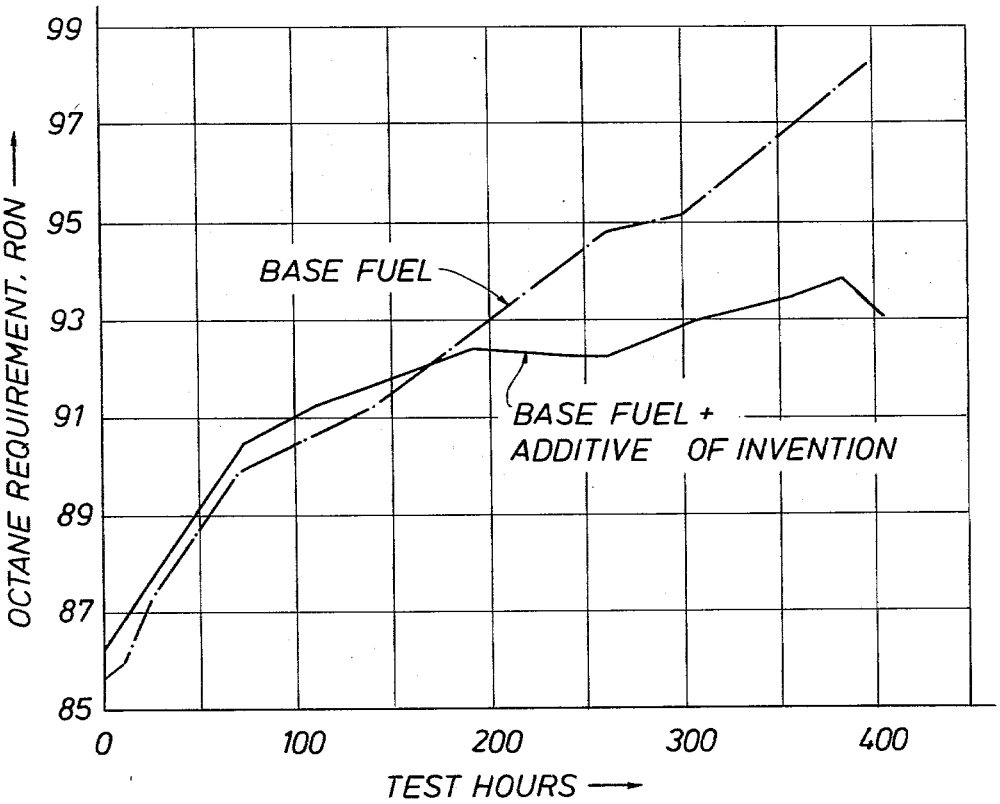
FIG.2 OCTANE REQUIREMENT REDUCTION ACTIVITY OF FUEL OF THE INVENTION
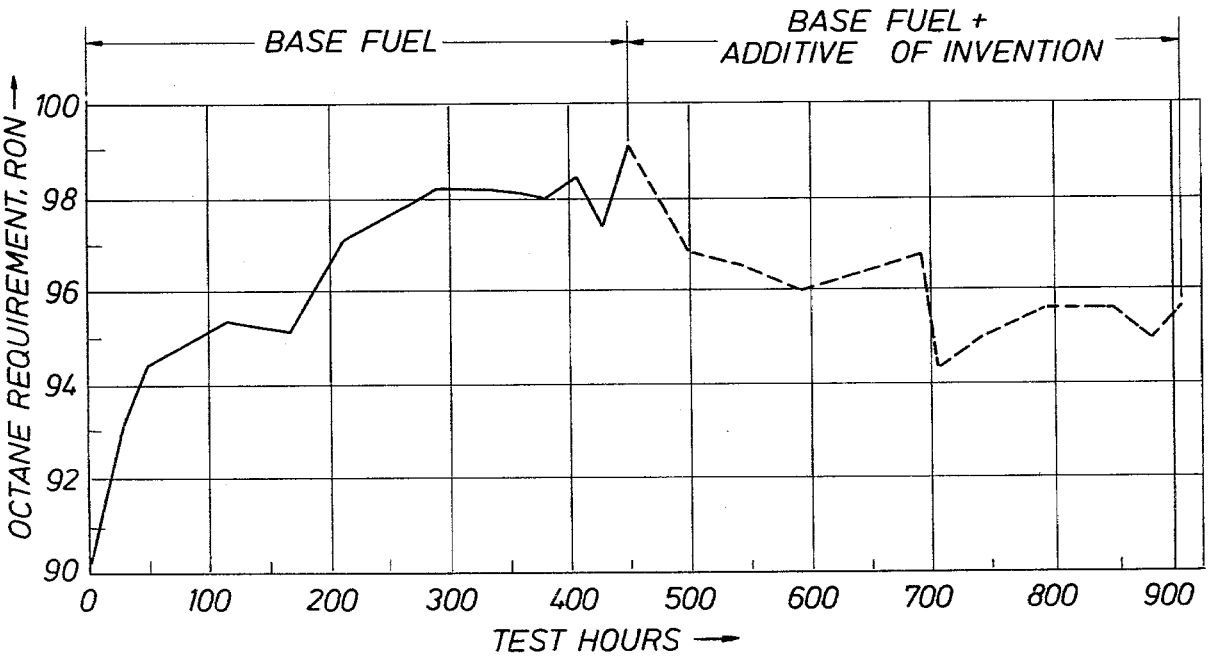

METHOD AND FUEL COMPOSITION FOR CONTROL OR REVERSAL OF OCTANE REQUIREMENT INCREASE AND FOR IMPROVED FUEL ECONOMY

FIELD OF THE INVENTION

This invention relates to improved hydrocarbon fuels which control or reverse the octane requirement increase (ORI) phenomenon conventionally observed during the initial portion of the operating life of spark ignition internal combustion engines, and further improves the fuel economy, i.e., lowers the fuel consumption rates of said engine operated on said fuels according to the invention.

The octane requirement increase (ORI) effect exhibited by internal combustion engines, e.g., spark ignition engines, is well known in the art. This effect may be described as the tendency for an initially new or clean engine to require higher octane quality fuel as operating time accumulates, and is coincidental with the formation of deposits in the region of the combustion chamber of the engine. Thus, during the initial operation of a new or clean engine, a gradual increase in octane requirement (OR), i.e., fuel octane number required for knock-free operation, is observed with an increasing buildup of combustion chamber deposits until a rather stable or equilibrium OR level is reached which, in turn, seems to correspond to a point in time where the quantity of deposit accumulation on the combustion chamber and valve surfaces no longer increases but remains relatively constant. This so-called "equilibrium value" is usually reached between about 3,000 and 20,000 miles or corresponding hours of operation. The actual equilibrium value of this increase can vary with engine design and even with individual engines of the same design; however, in almost all cases the increase appears to be significant, with ORI values ranging from about 2 to 14 Research Octane Numbers (RON) being commonly observed in modern engines.

It is also known that additives may prevent or reduce deposit formation, or remove or modify formed deposits, in the combustion chamber and adjacent surfaces and hence decrease OR. Such additives are generally known as octane requirement reduction (ORR) agents.

DESCRIPTION OF THE PRIOR ART

It is known from U.S. Pat. No. 3,502,451 (incorporated herein by reference) that gasoline compositions containing from about 0.01 to 0.20 percent of a $C_2$ to $C_6$ polyolefin polymer or hydrogenated polymer having an average molecular weight in the range from about 500 to 3500 is effective to reduce deposits on intake valves and ports of spark ignited internal combustion engines. However, there is evidence that use of such polymers alone is not particularly effective in the inhibition or prevention of octane requirement increase.

The use of oil soluble aliphatic polyamines containing at least one olefinic polymer chain to improve detergent properties of fuel and lubricant compositions is disclosed in a number of patents including U.S. Pat. Nos. 3,275,554; 4,438,757; 3,565,804; 3,574,576; 3,898,056; 3,960,515, 4,022,589 and 4,039,300, and their disclosures are incorporated by reference.

SUMMARY OF THE INVENTION

It has now been found that when minor amounts of a combination of (a) certain oil soluble polyamines containing at least one olefinic polymer chain, and (b) certain polymers of monoolefins having up to 6 carbon atoms in certain ratios are used as a gasoline additive, a significant reduction in ORI is produced, together with improved fuel economy of the engine.

Accordingly, the invention provides a method for operating a spark ignition internal combustion engine which comprises introducing with the combustion intake charge to said engine an octane-requirement-increase inhibiting amount of (a) an oil soluble aliphatic polyamine containing at least one olefinic polymer chain and having a molecular weight in the range from about 600 to about 10,000 and attached to nitrogen and/or carbon atoms of the alkylene radicals connecting the amine nitrogen atoms, and at a concentration of 0.2–1.5 ppm basic nitrogen content based upon the fuel component of said intake charge; and (b) a polymeric component which is (i) a polymer of a $C_2$ to $C_6$ monoolefin, (ii) a copolymer of a $C_2$ to $C_6$ monolefins, (iii) the corresponding hydrogenated polymer or copolymer, or (iiii) mixtures of at least two of (i), (ii) and (iii), said polymeric component having a number average molecular weight in the range from about 500 to 1500, and at a concentration of 250–1200 ppmw based upon the fuel component of said intake charge.

The invention further provides a motor fuel composition comprising a mixture of hydrocarbons of the gasoline boiling range containing an octane requirement increase-inhibiting amount of (a) an oil soluble aliphatic polyamine containing at least one olefinic polymer chain and having a molecular weight in the range from about 600 to about 10,000 and attached to nitrogen and/or carbon atoms of the alkylene radicals connecting the amino nitrogen atoms, said polyamine being present at a concentration in the range of 0.2–1.5 ppmw basic nitrogen; and (b) from 250–1200 ppmw of a polymeric component which is (i) a polymer of a $C_2$ to $C_6$ monoolefin, (ii) a copolymer of a $C_2$ to $C_6$ monoolefin, (iii) the corresponding hydrogenated polymer or copolymer, or (iiii) mixtures of (i), (ii) and/or (iii), said polymeric component having a number average molecular weight in the range from about 500–1500.

Further provided according to the invention is an additive concentrate comprising (a) from 0.5 to 1.3 percent by weight of the hereinabove described polyamines, (b) from 6 to 24 percent by weight of a polymeric component which is (i) a polymer of a $C_2$ to $C_6$ monoolefin, (ii) a copolymer of a $C_2$ to $C_6$ monoolefin, (iii) the corresponding hydrogenated polymer of copolymer, or (iiii) mixtures of at least two of (i), (ii), and (iii), said polymeric component having a number average molecular weight in the range from about 500–1500, and (c) balance of a fuel compatible diluent boiling in the range from about 50° C. (122° F.) to about 232° C. (450° F.).

BRIEF DESCRIPTION OF THE DRAWINGS

FIG. 1 is a graph comparing the ORI activity of an engine from which all deposits were removed at start, in one test with a non-detergent base fuel and another test with a fuel according to the invention.

FIG. 2 is a graph showing the ORI of an engine run on base fuel, which OR is reduced considerably by switching to a fuel according to the invention.

DESCRIPTION OF THE PREFERRED EMBODIMENTS

Figure 3:
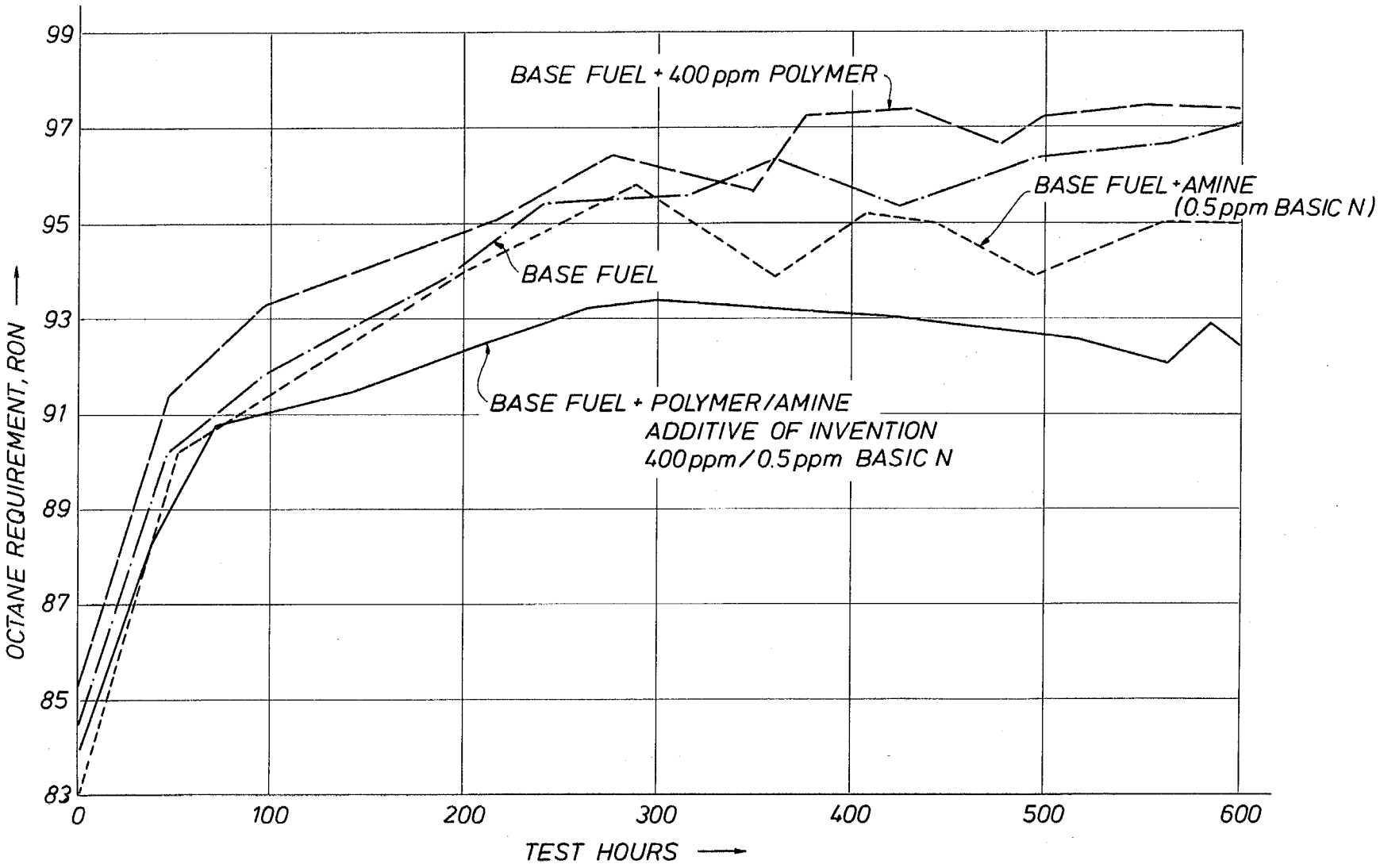
FIG. 3 is a graph showing the ORI of an engine operated on base fuel alone, base fuel with each additive component separately and the activity of the combination additives according to the invention in the same base fuel.
Figure 4:
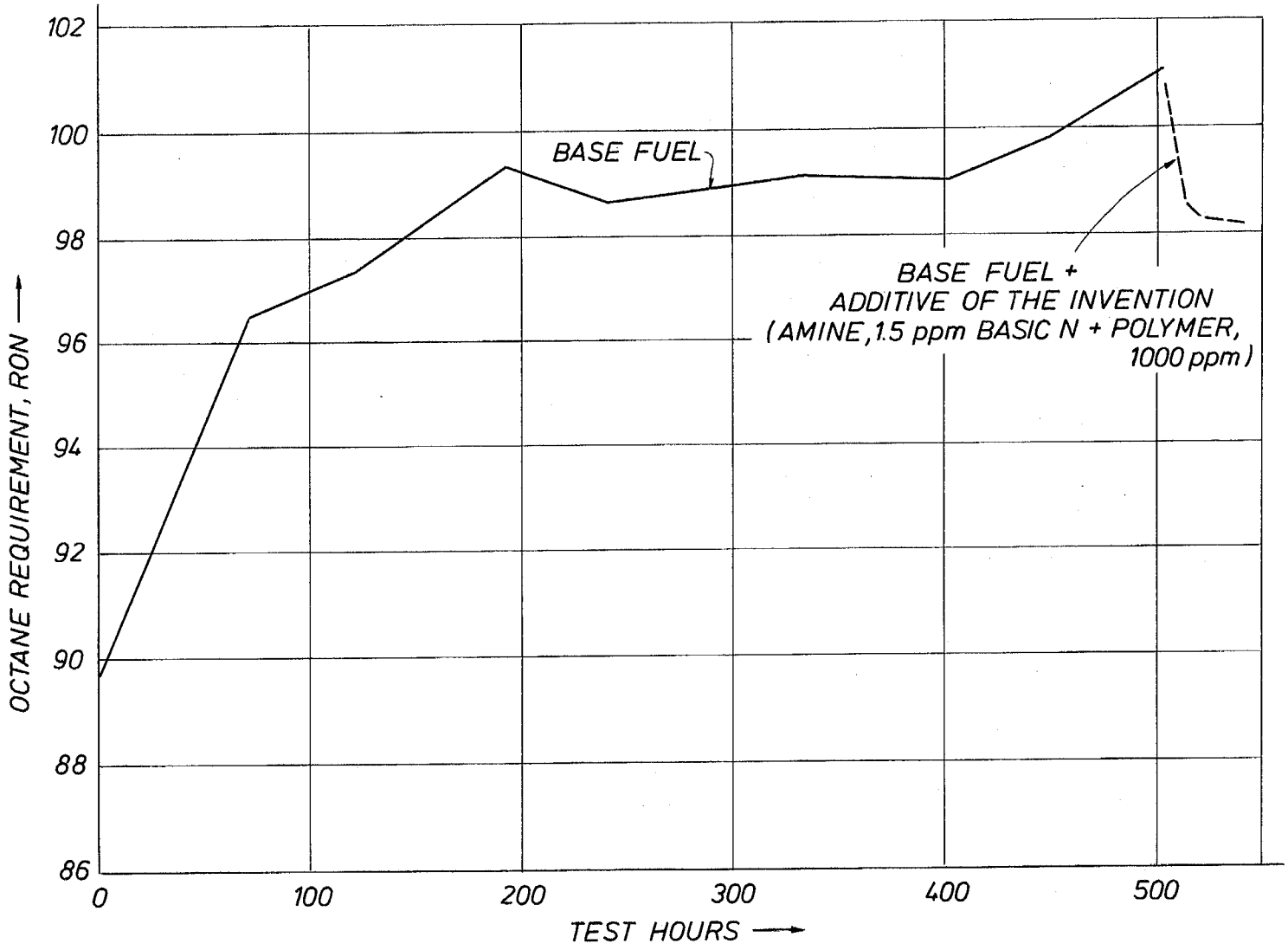
FIG. 4 is a graph showing the ORI of an engine operated on base fuel alone, followed by rapid reduction in OR by switching to a fuel according to the invention.

The polymeric component of the instant invention is well known in the art and patents related to their manufacture and use include, e.g., U.S. Pat. Nos. 2,692,257, 2,692,258, 2,692,259, 2,918,508 and 2,970,179, and their disclosures are incorporated herein by reference.

The polymers of monoolefins which are employed in the motor fuel of the invention are characterized by a number average molecular weight by osmometry in the range from about 500 to 1500 and preferably about 550 to 1000. Particularly preferred are those having said average molecular weight in the range from about 600 to about 950. Mixtures of polymers wherein a substantial portion of the mixture has a molecular weight above 1500 are considerably less effective. The polyolefins may be prepared from unsaturated hydrocarbons having from two to six carbon atoms including, e.g., ethylene, propylene, butylene, isobutylene, butadiene, amylene, isoprene, and hexene.

Preferred for their efficiency and commercial availability are polymers of propylene and butylene; particularly preferred are polymers of polyisobutylene. Also suitable and part of this invention are derivatives resulting after hydrogenation of the above polymers.

The oil soluble aliphatic polyamine component has at least one polymer chain having a molecular weight in the range from about 500 to about 9,900 and preferably from about 550 to about 4,900, and particularly from 600 to 1,300, and which may be saturated or unsaturated and straight or branch chain and attached to nitrogen and/or carbon atoms of the alkylene radicals connecting the amino-nitrogens.

Preferred polyolefin-substituted polyalkylene polyamines have the structural formula:

$$R-\overset{\overset{\displaystyle R}{|}}{N}-R'-(N-R')_x-\overset{\overset{\displaystyle R''}{|}}{N}-R''$$

where R is selected from the group consisting of hydrogen and polyolefin having a molecular weight from about 500 to about 9,900, at least one R being polyolefin, R' is an alkylene radical having from 1 to 8 carbon atoms, preferably 1 to 4 carbon atoms, R'' is hydrogen or lower alkyl, and x is 0–5. Preferred is when one R is a branch-chain olefin polymer in the molecular weight range of 550 to 4,900, with a molecular weight range of 600–1300 being particularly preferred, and the other R is hydrogen.

The olefinic polymers (R) which are reacted with polyamines to form the additive of the present invention include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substituted alkenyl and alkyl groups are polyethylene groups, polypropylene groups, polybutylene groups, polyisobutylene groups, polyethylene-polypropylene groups, polyethylene-polyalpha-methyl styrene groups and the corresponding groups without double bonds. Particularly preferred are polypropylene and polyisobutylene groups.

The R'' group may be hydrogen but is preferably lower alkyl, i.e., containing up to 7 carbon atoms and more preferably is selected from methyl, ethyl, propyl and butyl.

The polyamines used to form the aliphatic polyamine compounds of this invention include primary and secondary low molecular weight aliphatic polyamines such as ethylene diamine, diethylene triamine, triethylene tetramine, propylene diamine, butylene diamine, trimethyl trimethylene diamine, tetramethylene diamine, diaminopentane or pentamethylene diamine, hexamethylene diamine, heptamethylene diamine, diaminooctane, decamethylene diamine, and higher homologues up to 18 carbon atoms. In the preparation of these compounds the same amines can be used or substituted amines can be used such as:

N-methyl ethylene diamine,
N-propyl ethylene diamine,
N,N-dimethyl 1,3-propane diamine,
N-2-hydroxypropyl ethylene diamine,
penta-(1-methylpropylene)hexamine,
tetrabutylene-pentamine,
hexa-(1,1-dimethylethylene)heptamine,
di-(1-methylamylene)-triamine,
tetra-(1,3-dimethylpropylene)pentamine,
penta-(1,5-dimethylamylene)hexamine,
di(1-methyl-4-ethylbutylene)triamine,
penta-(1,2-dimethyl-1-isopropylethylene)hexamine,
tetraoctylenepentamine and the like.

Compounds possessing triamine as well as tetramine and pentamine groups are applicable for use because these can be prepared from technical mixtures of polyethylene polyamines, which offers economic advantages.

The polyamine from which the polyamine groups may have been derived may also be a cyclic polyamine, for instance, the cyclic polyamines formed when aliphatic polyamines with nitrogen atoms separated by ethylene groups were heated in the presence of hydrogen chloride.

An example of a suitable process for the preparation of the compounds employed according to the invention is the reaction of a halogenated hydrocarbon having at least one halogen atom as a substituent and a hydrocarbon chain as defined hereinbefore with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at elevated temperature in the presence of a solvent; particularly a solvent having a boiling point of at least 160° C.

The reaction between polyhydrocarbon halide and a polyamine having more than one nitrogen atom available for this reaction is preferably effected in such a way that cross-linking is reduced to a minimum, for instance, by applying an excess of polyamine.

The amine additive according to the invention may be prepared, for instance, by alkylation of low molecular weight aliphatic polyamines. For instance, a polyamine is reacted with an alkyl or alkenyl halide. The formation of the alkylated polyamine is accompanied by the formation of hydrogen halide, which is removed, for instance, as a salt of starting polyamine present in excess. With this reaction between alkyl or alkenyl halide and the strongly basic polyamines dehalogenation of the alkyl or alkenyl halide may occur as a side reaction, so that hydrocarbons are formed as by-products. Their removal may, without objection be omitted. The amount of aliphatic polyamine used in the fuel will generally be sufficient that the basic nitrogen content of the fuel is in the range from about 0.2 to 1.5 ppmw. This generally corresponds to concentration in the range from about 6 to about 600 ppm depending upon the molecular weight of the aliphatic polyamine. Highly effective results have been realized when the aliphatic polyamine is present in amounts sufficient to impart to the fuel a basic nitrogen in the range of from about 0.3 to 1.0 ppm.

Basic nitrogen content of the fuels of this invention is conveniently determined by a procedure requiring concentration by evaporating to near dryness, dilution of the residue with isooctane and potentiometric titration with alcoholic 0.1 N hydrochloric acid. Add 1 gram of neutral mineral white oil, suitably "Nugol," to each of replicate 75 gram samples of the fuel which are then evaporated on a steam plate under a stream of nitrogen gas to a residue of 1.5–3 grams. The residue is diluted with about 50 ml of isooctane, 10 ml of methyl ethyl ketone, 5 ml of chloroform and is tritrated with alcoholic standardized 0.01 to 0.05 N hydrochloric acid (approximately 0.9 to 4.5 ml of concentrated HCl in 1 liter of anhydrous isopropyl alcohol) using a standard pH combination electrode with a ceramic-glass junction (Metrohm EA-120, Brinkman Instruments, Houston, Tex.) with a mettler SR-10 automatic trigger, in the equilibrium mode. Potentiometer meter readings are plotted against volume of the titration solution and the end point is taken as the inflection point of the resulting curve. A blank titration should be made on the fuel without the combination additive according to the invention. Basic nitrogen, ppmw is calculated according to the following formula:

$$\text{Basic nitrogen, ppm}w = \frac{(V - b) \times n \times 14 \times 10^3}{w}$$

where v = milliliters of HCl used to the inflection point b = milliliters of HCl used for blank to same inflection point n = normality of the HCl w = weight of gasoline sample.

For concentrations above 1 ppmw basic nitrogen, the value is the average of triplicate determinations which do not differ by more than 0.3 ppmw. For concentrations less than 1 ppmw basic nitrogen, the value is the average of five determinations which do not differ by more than 0.3 ppmw.

Suitable liquid hydrocarbon fuels of the gasoline boiling range are mixtures of hydrocarbons having a boiling range of from about 25° C. (77° F.) to about 232° C. (450° F.), and comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer and trimerized olefins, synthetically-produced aromatic hydrocarbon mixtures, from thermally or catalytically reformed hydrocarbons, or from catalytically cracked or thermally cracked petroleum stocks, and mixtures of these. The hydrocarbon composition and octane level of the base fuel are not critical. Any conventional motor fuel base may be employed in the practice of this invention.

Normally, the hydrocarbon fuel mixtures to which the invention is applied are substantially lead-free, but may contain minor amounts of blending agents such as methanol, ethanol, methyl tertiary butyl ether, and the like. The fuels may also contain antioxidants such as phenolics, e.g., 2,6-di-tert-butylphenol or phenylenediamines, e.g., N,N'-di-sec-butyl-p-phenylenediamine, dyes, metal deactivators, dehazers such as polyester-type ethoxylated alkylphenol-formaldehyde resins and the like. The fuels may also contain antiknock compounds such as tetraethyl lead, a methyl cyclopentadienylmanganese tricarbonyl, ortho-azidophenol and the like.

The octane requirement reduction agent of the present invention can be introduced into the combustion zone of the engine in a variety of ways to prevent buildup of deposits, or to accomplish reduction or modification of deposits. Thus the ORR agent can be injected into the intake manifold intermittantly or substantially continuously, as described, preferably in a hydrocarbon carrier having a final boiling point (by ASTM D86) lower than about 232° C. (450° F.). A preferred method is to add the agent to the fuel. For example, the agent can be added separately to the fuel or blended with other fuel additives.

The invention further provides a concentrate for use in liquid hydrocarbon fuel in the gasoline boiling range comprising (a) from 0.5 to 1.3 percent by weight of the hereinabove described polyamines, (b) from 6 to 24 percent by weight of a polymeric component which is (i) a polymer of a $C_2$ to $C_6$ monoolefin, (ii) a copolymer of a $C_2$ to $C_6$ monoolefin, (iii) the corresponding hydrogenated polymer or copolymer, or (iiii) mixtures of at least two of (i), (ii), and (iii), said polymeric component having a number average molecular weight in the range from about 500 to 1500, optionally from about 0.01 to 0.2 percent by weight of a dehazer and (d) balance a diluent, boiling in the range from about 50° C. (122° F.) to about 232° C. (450° F.). Very suitable diluents include oxygen-containing hydrocarbons and non-oxygen-containing hydrocarbons. Suitable oxygen-containing hydrocarbon solvents include, e.g., methanol, ethanol, propanol, methyl tert-butyl ether and ethylene glycol monobutyl ether. The solvent may be an alkane such as heptane, but preferably is an aromatic hydrocarbon solvent such as toluene, xylene alone or in admixture with said oxygen-containing hydrocarbon solvents. Optionally, the concentrate may contain from about 0.01 to about 0.2% by weight of a dehazer, particularly a polyester-type ethoxylated alkylphenol-formaldehyde resin.

The invention will now be illustrated with reference to the following examples.

EXAMPLE I

Two 400-hour tests were run in a single 1979 Pontiac 301 CID engine equipped with a two-barrel carburetor and automatic transmission. Both tests were started with the engine in clean condition, i.e., from which all deposits had been removed from the intake manifolds, intake ports and combustion chamber area of the engine. One test was run using the base fuel which was a 96 Research Octane Number (RON) premium unleaded type gasoline containing no detergent; the other test was run with the same base fuel but containing an additive mixture according to the invention, namely, polyisobutylene diamine propane wherein the polyisobutylene component has an average molecular weight of about 900 and at a concentration of about 0.5 parts per million by weight (ppmw) basic nitrogen, together with 400 ppmw of a polyisobutylene having a number average molecular weight by osmometry of about 730. The engine was mounted on a dynamometer stand equipped with a flywheel to simulate inertia of a car. In order to accumulate deposits in the engine during each test, the engine was operated on a cycle consisting of an idle mode and 57 and 105 Kilometer/hour (35 and 65 mile per hour) cruise modes with attendant accelerations and decelerations.

The octane requirement of the engine was determined with full boiling range unleaded reference fuels while operating the engines at 2500 revolutions per minute, wide-open throttle and transmission in second gear. For the rating tests, reference fuels of one octane number increments were used; the octane requirement is that of the reference fuel which gives a trace level of knock. For example, if one reference fuel, e.g., 96 octane number, gives no knock, but the reference fuel of one octane number lower (95 octane number) gives a higher than trace level of knock, the octane requirement is recorded as the mean value (95.5 octane number in this hypothetical example); hence, in these tests, values which differ by only±0.5 octane number are considered to be insignificant. Octane requirement values of other than half-number increments result from barometric pressure correction to determine the octane number.

During the octane requirement tests and during most of the cyclic operations of the engine, the following temperatures were maintained: jacket water out 95° C. (203° F.); oil gallery, 95° C. (203° F.); and carburetor air, 45° C. (113° F.) with constant humidity. Engine lubricant was a commercially available 10 w-40 grade oil of API SE quality.

Results of both 400 hour long tests, equivalent to about 14,500 miles, is shown in FIG. 1.

As may be seen, the octane requirement (OR) of the engine was about the same for the first 200 test hours. However, for the last half of the test, the additive-containing fuel according to the invention resulted in a lower OR than the base fuel (about five octane number lower at the end of the test). The results of this test clearly demonstrate the octane requirement increase control activity of a fuel composition according to the invention.

EXAMPLE II

The procedure of Example I for the first test was repeated with another similarly equipped 1979 Pontiac 301 CID engine except that the engine was operated on the base fuel for 450 hours (equivalent to 16,500 miles), followed by an additional 450 hours on an additive containing fuel according to the invention, identical to that employed in Example I. The results shown in FIG. 2 demonstrate that the additive fuel according to the invention lowered the OR quickly and maintained it at a low level for the duration of the test.

EXAMPLE III

The effect of fuel according to the invention on the fuel consumption of the engines as tested in Examples I and II above was also investigated. The fuel economy of the engines was measured using simulated level road load speed conditions. The rate of fuel consumption after 400 to 450 hours of operation on the base fuel was measured for each engine, and again after about 400 or 458 hours subsequent operation on the additive containing base fuel, as shown in Table I. The fuel consumption for the engine of Example I was 2.2% lower at 65 mph and 5.2% lower at 30 mph on the additive fuel than on the base fuel. With the engine of Example II, the additive fuel gave 1.3 to 3.5% lower fuel consumption than the base fuel.

TABLE I

EFFECT OF ADDITIVE-FUEL ON FUEL CONSUMPTION

| Test Engine of Examples | Test Fuel | Time on Test Fuel, hours | FUEL CONSUMPTION 65 mph g/min | 65 mph % reduct[b] | 55 mph g/min | 55 mph % reduct[b] | 45 mph g/min | 45 mph % reduct[b] | 35 mph g/min | 35 mph % reduct[b] | 30 mph g/min | 30 mph % reduct[b] |
|---|---|---|---|---|---|---|---|---|---|---|---|---|
| I | Base[a] | 400 | 156.6 | — | 120.8 | — | 88.6 | — | 62.9 | — | 51.5 | — |
| | Base + Additive Package | 409 | 153.2 | 2.2 | 118.2 | 2.2 | 85.2 | 3.8 | 59.7 | 5.1 | 48.8 | 5.2 |
| II | Base[a] | 450 | 153.1 | — | 118.6 | — | 87.5 | — | 62.2 | — | 51.0 | — |
| | Base + Additive Package | 458 | 149.5 | 1.7 | 117.0 | 1.3 | 85.3 | 2.5 | 60.9 | 2.1 | 49.2 | 3.5 |

[a]96 RON Premium Unleaded-type gasoline without detergent additive.
[b]Percent reduction in fuel consumption with additive fuel relative to base fuel.

EXAMPLE IV

A series of four tests were conducted in a single 1978 Pontiac 301 CID engine equipped with a 2 barrel carburetor and an automatic transmission as described in Example I. All tests were started with the engine in clean condition. To determine whether either of the additive components alone would result in the advantageous octane-requirement control, the engine was tested with base fuel alone, with each of the additives alone, and again in combination, using the test procedure of Example I except that the tests were conducted for a period of about 600 hours each, equivalent to about 21,750 miles. As shown in FIG. 3, the use of polyisobutylene alone resulted in an octane-requirement substantially that of the base fuel alone, while the use of the amine component alone showed small advantage compared to the result achieved by use of the combined additive.

EXAMPLE V

The procedure of Example IV was repeated in a single test in the same engine using the same base fuel but containing the polyisobutylene at higher dosage of 1000 ppmw. After about 300 hours, the Octane Requirement had stabilized at about 94.8–95.6 and remained there for the duration of the test, comparable to the use of the amine component alone at 0.5 ppm basic nitrogen.

EXAMPLE VI

The procedure of Example II was repeated except that the polyisobutylene was replaced with polypropene having an average molecular weight by osmometry of about 800. Related results were obtained.

EXAMPLE VII

The procedure of Example II was repeated with another similarly equipped 1979 Pontiac engine except that the engine was operated on the base fuel for 504 hours (equivalent to 18,300 miles, followed by 39 hours on the same fuel but containing an additive mixture according to the invention, namely the same components as in Example 1, but at higher concentration of 1.5 ppmw basic nitrogen and 1000 ppmw polymer. As may be seen, there was a rapid reduction in octane-requirement of the engine, about 3 octane number after just 39 hours of operation. However, continued use of the additive according to the invention at high dosages typically results in only temporary reduction in octane-requirement.

What is claimed is:

1. A method for operating a spark ignition internal combustion engine which comprises introducing with the combustion intake charge to said engine an octane-requirement-increase inhibiting amount of (a) an oil soluble aliphatic polyamine, containing at least one olefinic polymer chain, and having a molecular weight in the range from about 600 to about 10,000 and attached to nitrogen and/or carbon atoms of the alkylene radicals connecting the amino nitrogen atoms, and at a concentration of 0.2–1.5 ppm basic nitrogen content based upon the fuel component of said intake charge; and (b) a polymeric component which is (i) a polymer of a $C_2$ to $C_6$ monoolefin, (ii) a copolymer of a $C_2$ to $C_6$ monoolefin, (iii) the corresponding hydrogenated polymer or copolymer, and (iiii) mixtures of at least two (i), (ii) and (iii), said polymeric component having a number average molecular weight in the range from about 500 to 1500, and at a concentration of 250–1200 ppmw based upon the fuel component of said intake charge.

2. A method as in claim 1 wherein said component (a), the aliphatic polyamine, has the structural formula:

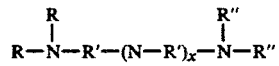

where R is selected from the group consisting of hydrogen and polyolefin having a molecular weight of from about 550 to about 4900, at least one R being polyolefin, R′ is an alkylene radical having from 1 to 8 carbon atoms, R″ is hydrogen or lower alkyl and x is 0 to 5.

3. A method as in claim 2 wherein in said structural formula one R is hydrogen and one R is selected from the group consisting of a polypropylene or polyisobutylene having a molecular weight from about 600 to 1300.

4. A method as in claim 1 wherein component (b) is a polymer of a $C_3$ or $C_4$ monoolefin and has a number average molecular weight in the range from about 600–950.

5. A method as in claim 3 wherein component (b) is present in a concentration from about 300 to 600 ppmw.

6. A motor fuel composition comprising a mixture of hydrocarbon of the gasoline boiling range containing an octane requirement increase-inhibiting amount of (a) an oil soluble aliphatic polyamine, containing at least one olefinic polymer chain, and having a molecular weight in the range from about 600 to about 10,000 and attached to nitrogen and/or carbon atoms of the alkylene radicals connecting the amino nitrogen atoms, said polymer being present at a concentration of 0.2–1.5 ppmw basic nitrogen; and (b) from 250–1200 ppmw of a polymeric component which is (i) a polymer of a $C_2$ to $C_6$ monoolefin, (ii) a copolymer of a $C_2$ to $C_6$ monoolefin, (iii) the corresponding hydrogenated polymer or copolymer, or (iiii) mixtures of (i), (ii) and/or (iii), said polymeric component having a number average molecular weight in the range from about 500–1500.

7. The composition of claim 6 wherein said component (a), the aliphatic polyamine, has the structural formula:

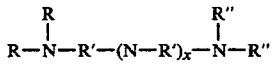

where R is selected from the group consisting of hydrogen and polyolefin having a molecular weight of from about 550 to about 4900, at least one R being polyolefin, R′ is an alkylene radical having from 1 to 8 carbon atoms, R″ is hydrogen or lower alkyl and x is 0 to 5.

8. The composition of claim 7 wherein said structural formula one R is hydrogen and one R is selected from the group consisting of polypropylene and polyisobutylene having a molecular weight from about 600 to 1300.

9. The composition of claim 6 wherein component (b) is a polymer of a $C_3$ or $C_4$ monoolefin and has an average molecular weight in the range from about 600–950.

10. The composition as in claim 9 wherein component (b) is present in a concentration from about 300 to 600 ppmw.

11. A concentrate suitable for use in liquid hydrocarbon fuel in the gasoline boiling range comprising (a) from 0.5 to 1.3 percent by weight of an oil soluble aliphatic polyamine, containing at least one olefinic polymer chain, and having a molecular weight in the range from about 600 to about 10,000 and attached to nitrogen and/or carbon atoms of the alkylene radicals connecting the amino nitrogen atoms, and at a concentration of 0.2–1.5 ppm basic nitrogen content based upon the fuel component of said intake charge, and (b) from 6 to 24 percent by weight of a polymeric component which is (i) a polymer of a $C_2$ to $C_6$ monoolefin, (ii) a copolymer of a $C_2$ to $C_6$ monoolefin, (iii) the corresponding hydrogenated polymer or copolymer, or (iiii) the mixtures of at least two of (i), (ii), and (iii), said polymeric component having a number average molecular weight in the range from about 500 to 1500, and (c) balance of a fuel compatible diluent boiling in the range from about 50° C. (122° F.) to about 232° C. (450° F.).

* * * * *